US010935918B2

(12) United States Patent
Iijima

(10) Patent No.: US 10,935,918 B2
(45) Date of Patent: Mar. 2, 2021

(54) PRINTING APPARATUS

(71) Applicant: SEIKO EPSON CORPORATION, Tokyo (JP)

(72) Inventor: Takayuki Iijima, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 143 days.

(21) Appl. No.: 15/865,796

(22) Filed: Jan. 9, 2018

(65) Prior Publication Data

US 2018/0203396 A1 Jul. 19, 2018

(30) Foreign Application Priority Data

Jan. 17, 2017 (JP) ..... JP2017-005899

(51) Int. Cl.
*G03G 15/00* (2006.01)
*G03G 15/20* (2006.01)
*G03G 21/16* (2006.01)

(52) U.S. Cl.
CPC ..... *G03G 15/6508* (2013.01); *G03G 15/6567* (2013.01); *G03G 15/2028* (2013.01); *G03G 21/1604* (2013.01)

(58) Field of Classification Search
CPC ..... G03G 15/6508; G03G 15/6567; G03G 15/2028; G03G 21/1604
See application file for complete search history.

(56) References Cited

U.S. PATENT DOCUMENTS 6,685,371 B1 * 2/2004 Holmberg ..... B41J 11/04 400/692
8,447,205 B2 * 5/2013 Eom ..... G03G 15/80 399/88
2002/0067513 A1 * 6/2002 Sasai ..... H04N 1/00538 358/400
2004/0130700 A1 * 7/2004 Ogi ..... B41J 29/02 355/133
2007/0230988 A1 10/2007 Nobe et al.
2007/0248377 A1 * 10/2007 Palumbo ..... G03G 21/1638 399/107
2009/0035007 A1 * 2/2009 Eom ..... G03G 15/80 399/88
2011/0076047 A1 3/2011 Nobe et al.
2014/0060432 A1 * 3/2014 Onodera ..... B41J 29/38 118/712
2015/0229077 A1 * 8/2015 Little ..... H01R 12/724 439/78
2018/0131087 A1 * 5/2018 Kim ..... H01L 23/552

FOREIGN PATENT DOCUMENTS

JP 05-201100 A 8/1993
JP 2001-260470 9/2001
JP 2002-025644 A 1/2002
JP 2002-353639 A 12/2002
JP 2007-261154 A 10/2007

* cited by examiner

*Primary Examiner* — David H Banh
(74) *Attorney, Agent, or Firm* — Workman Nydegger

(57) ABSTRACT

A printing apparatus includes a driving source that drives a feeding portion for feeding a medium, a printing portion that performs printing on the medium, a substrate that includes a signal supplying portion for supplying a signal to the driving source and a power supplying portion for supplying power to the driving source, a shielding portion that covers the substrate, and a pair of side plates that is provided at an interval in a width direction to be connected to the shielding portion.

5 Claims, 5 Drawing Sheets

PRINTING APPARATUS

BACKGROUND

1. Technical Field

The present invention relates to a printing apparatus such as an ink jet type printer.

2. Related Art

From the related art, as an example of a printing apparatus, there is a printer which performs printing on a medium fed by a feeder (feeding portion). In addition, among such printers, there is a printer provided with a pair of side frames (side plates) which is disposed to face each other and a bottom frame for connecting the side frames with each other (for example, JP-A-2007-261154).

In this printer, a control substrate including a control circuit or a power source substrate for supplying power to the control substrate is attached to the side frame.

However, the substrate may be influenced by noise. Therefore, the substrate may be attached to the side frame in a state of being accommodated in a case (shielding portion), which is called an enclosure. However, in the case in which the substrate is accommodated in the case, the number of components is increased by an amount of cases.

Also, such problem is not limited to a printer to which a substrate is attached, and is generally common to a printing apparatus to which a substrate is attached.

SUMMARY

An advantage of some aspects of the invention is to provide a printing apparatus capable of suppressing influence of noise and increase of the number of components and attaching a substrate thereto.

Hereinafter, means of the invention and operation effects thereof will be described.

According to an aspect of the invention, there is provided a printing apparatus including a driving source that drives a feeding portion for feeding a medium, a printing portion that performs printing on the medium, a substrate that includes a signal supplying portion for supplying a signal to the driving source, and a power supplying portion for supplying power to the driving source, a shielding portion that covers the substrate, and a pair of side plates that is provided at an interval in a width direction to be connected to the shielding portion.

In this configuration, the pair of side plates is connected to each other by the shielding portion which covers the substrate. Therefore, the shielding portion serves as a member connecting the pair of side plates, and also serves as a member covering the substrate. Therefore, influence of noise and increase of the number of components can be suppressed, and the substrate can be attached.

In the printing apparatus, it is preferable that the shielding portion include a curved portion which is curved in a direction intersecting the width direction.

In this configuration, since the shielding portion includes the curved portion, stiffness of the shielding portion can be increased.

In the printing apparatus, it is preferable that the curved portion partition a wiring which connects the substrate and the driving source to each other and a setting portion in which the medium is set, and be curved to the setting portion side.

In this configuration, the curved portion is curved to the setting portion side. Also, the wiring is disposed in a space formed by the curved portion. Therefore, the space is effectively used, and thus the wiring can be disposed to be hidden by the shielding portion.

In the printing apparatus, it is preferable that a fixing member fixing the substrate to the shielding portion be further included, and the wiring which connects the substrate and the driving source to each other be attached to the fixing member.

In this configuration, when the wiring is attached to the fixing member for fixing the substrate, the fixing member serves as a member supporting the wiring, and also serves as a member fixing the substrate. Therefore, the increase of the number of components can be suppressed.

In the printing apparatus, it is preferable that the fixing member be formed of a metal, a signal wiring which connects the signal supplying portion and the driving source to each other be attached to a first surface of the fixing member, and a power wiring which connects the power supplying portion and the driving source to each other be attached to a second surface different from the first surface.

In this configuration, the fixing member is formed of a metal. Further, the signal wiring and the power wiring are attached to a different surface in the fixing member. Therefore, influence of noise of the signal wiring and the power wiring on each other can be reduced.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of a printing apparatus will be described with reference to drawings.

Figure 1:
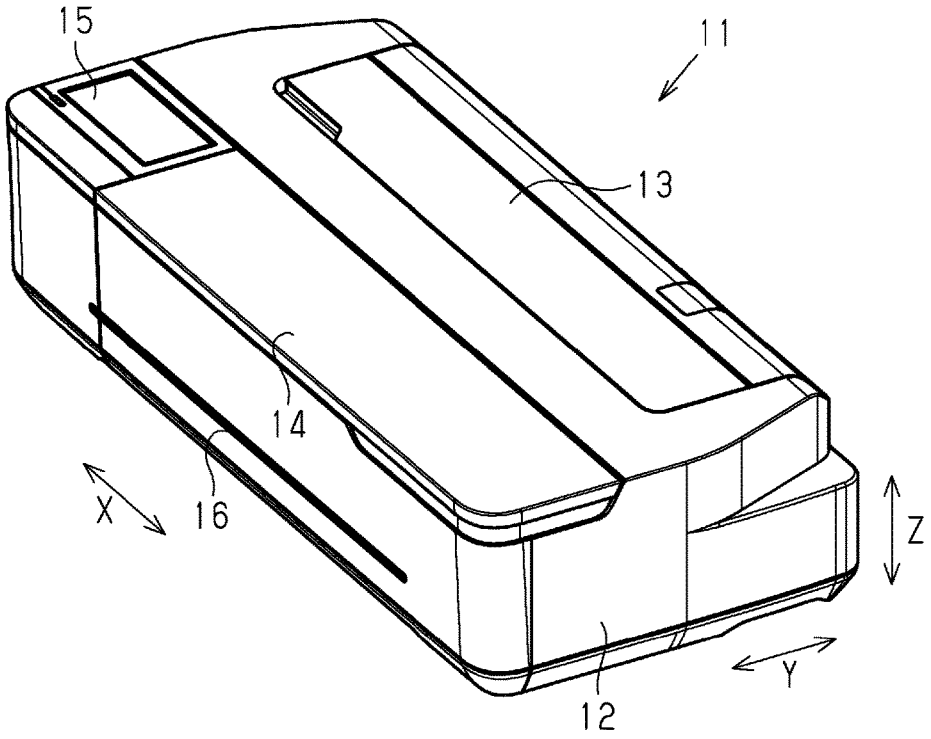
FIG. 1 is a schematic view of an embodiment of a printing apparatus.

Also, in the following description, when a printing apparatus 11 illustrated in FIG. 1 is disposed on a horizontal plane, a direction along an up direction and a down direction (vertical direction) is illustrated as an up and down direction Z, and a direction along a horizontal plane is illustrated as a width direction X and a depth direction Y. That is, the width direction X, the depth direction Y, and the up and down direction Z are different directions from one another, and intersect with one another (preferably, orthogonal to one another). In addition, one end side in the depth direction Y is set as a front side, and another end side opposite to the one end side is set as a back side.

As illustrated in FIG. 1, the printing apparatus 11 is provided with a case 12 in a substantially rectangular parallelepiped shape. In an upper surface of the case 12, a first cover 13 positioned on the back side, and a second cover 14 positioned on the front side are openable provided. An operating portion 15 for performing various operations of the printing apparatus 11 is provided at a position adjacent to the second cover 14 in the width direction X on the upper surface of the case 12. Also, a spout 16 to which a printed medium M (refer to FIG. 2) is discharged is provided on the front surface of the case 12.

Figure 2:
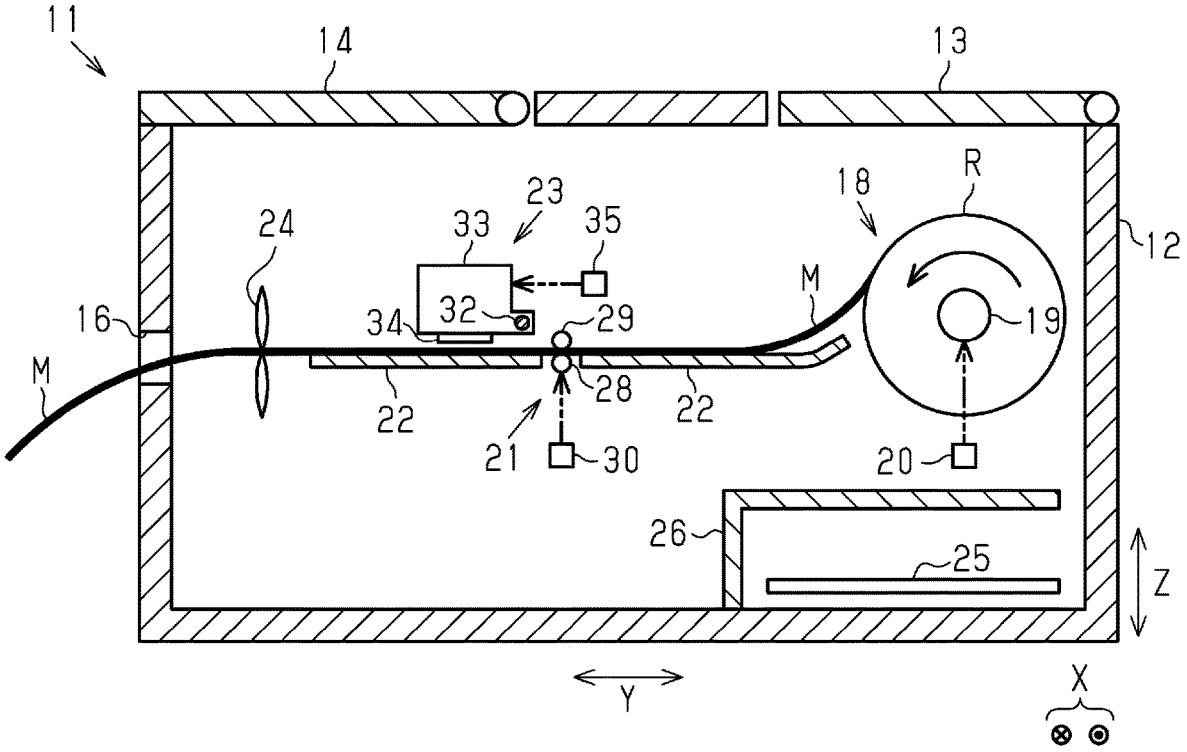
FIG. 2 is a side sectional perspective view illustrating an inner portion of the printing apparatus.

As illustrated in FIG. 2, inside the case 12, a setting portion 18 in which a roll R including the medium M wound thereon is set in a cylindrical shape, a feeding portion 19 for feeding the medium M from the setting portion 18, and a driving source 20 such as a motor which drives the feeding portion 19 are provided. The setting portion 18 is covered with the first cover 13 positioned at a closing position (refer to FIG. 2). Also, when the first cover 13 is positioned at an opening position (not illustrated), the setting portion 18 is capable of setting and replacing the roll R which is exposed to the outside.

The printing apparatus 11 is provided with a transporting portion 21 which transports the fed medium M, a supporting portion 22 which supports the transported medium M, a printing portion 23 which performs printing on the medium M, and a cutting portion 24 which cuts the printed medium M. Also, a substrate 25 which collectively controls driving of each mechanism in the printing apparatus 11, and a shielding portion 26 which is formed of a material covering the substrate 25 and is capable of shielding electromagnetic waves are provided on a lower side (gravity direction) of the setting portion 18. The shielding portion 26 partitions a space in which the setting portion 18 and the substrate 25 are provided. Therefore, the shielding portion 26 shields the substrate 25 with respect to a user by covering the substrate 25 from an upper side which becomes the first cover 13 side openable and closable in a case in which the medium M is set.

The feeding portion 19 holds a roll R so as to be rotatable and rotates the roll R in one direction (counterclockwise direction in FIG. 2) by being driven due to the driving source 20. Such a feeding portion 19 feeds the medium M by unwinding the roll R.

The transporting portion 21 is provided with a transporting roller 28 which applies a transportation force to the medium M, and a driven roller 29 which presses the medium M against the transporting roller 28. In addition, the printing apparatus 11 is provided with a transporting motor 30 which rotates and drives the transporting roller 28. When the transporting motor 30 is driven, the transporting roller 28 and the driven roller 29 pinching the medium M are rotated. Such a transporting portion 21 transports the medium M from the feeding portion 19 side, which becomes an upstream side of a transporting direction, toward the spout 16 side, which becomes a downstream side.

The printing portion 23 is provided with a guide shaft 32 which extends along the width direction X (scanning direction), a carriage 33 which is movably supported by the guide shaft 32, and a discharging head 34 which is supported by the carriage 33 and includes a plurality of nozzles (not illustrated) discharging ink to the medium M. Further, the printing apparatus 11 is provided with a carriage motor 35 which reciprocates the carriage 33 along the width direction X. When the carriage motor 35 is driven, the discharging head 34 moves along the width direction X with the carriage 33, and the printing portion 23 performs printing on the medium M by discharging ink from the discharging head 34.

Figure 3:
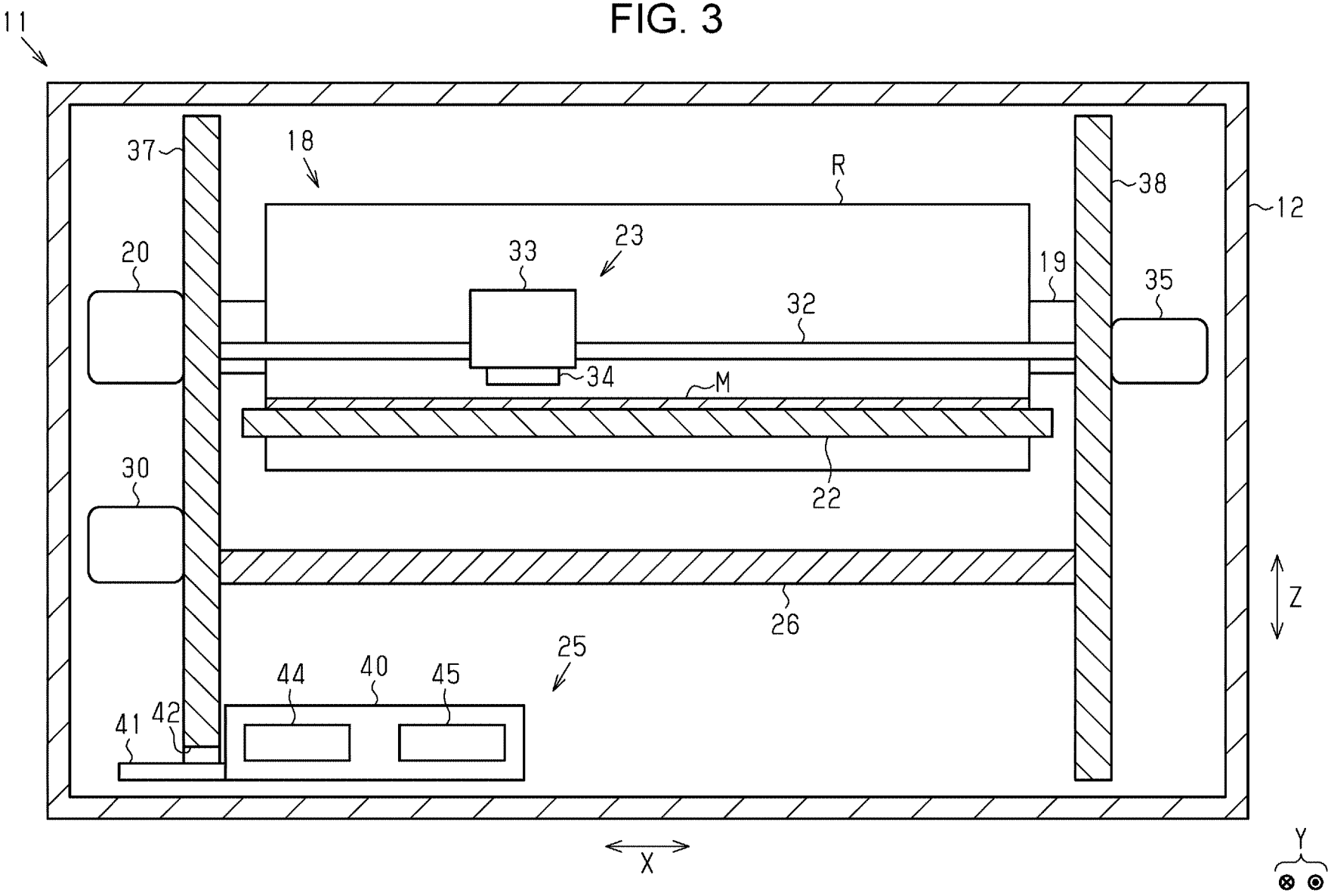
FIG. 3 is a sectional perspective view illustrating the inner portion of the printing apparatus seen from a front side.

As illustrated in FIG. 3, the printing apparatus 11 is provided with a pair of side plates 37 and 38 which is provided at an interval in the width direction X. The side plates 37 and 38 of the embodiment is provided in substantially parallel to each other along respectively the up and down direction Z and the depth direction Y, and is connected to the shielding portion 26 provided along the width direction X. Also, in the width direction X, the driving source 20 and the transporting motor 30 are provided on a first side plate 37 side. In addition, the carriage motor 35 is provided on a second side plate 38 side.

The substrate 25 is provided with a main body portion 40 which is provided on an inner region positioned between the pair of side plates 37 and 38, and a communicating portion 41 which performs wireless communication. The communicating portion 41 is provided on an outer region between the first side plate 37 and the case 12, which are positioned on an outer region of the pair of side plates 37 and 38 through a notch portion 42 formed on the first side plate 37. Also, the inner region is a region covered with the shielding portion 26, and the outer region is a region which is not covered with the shielding portion 26.

Figure 4:
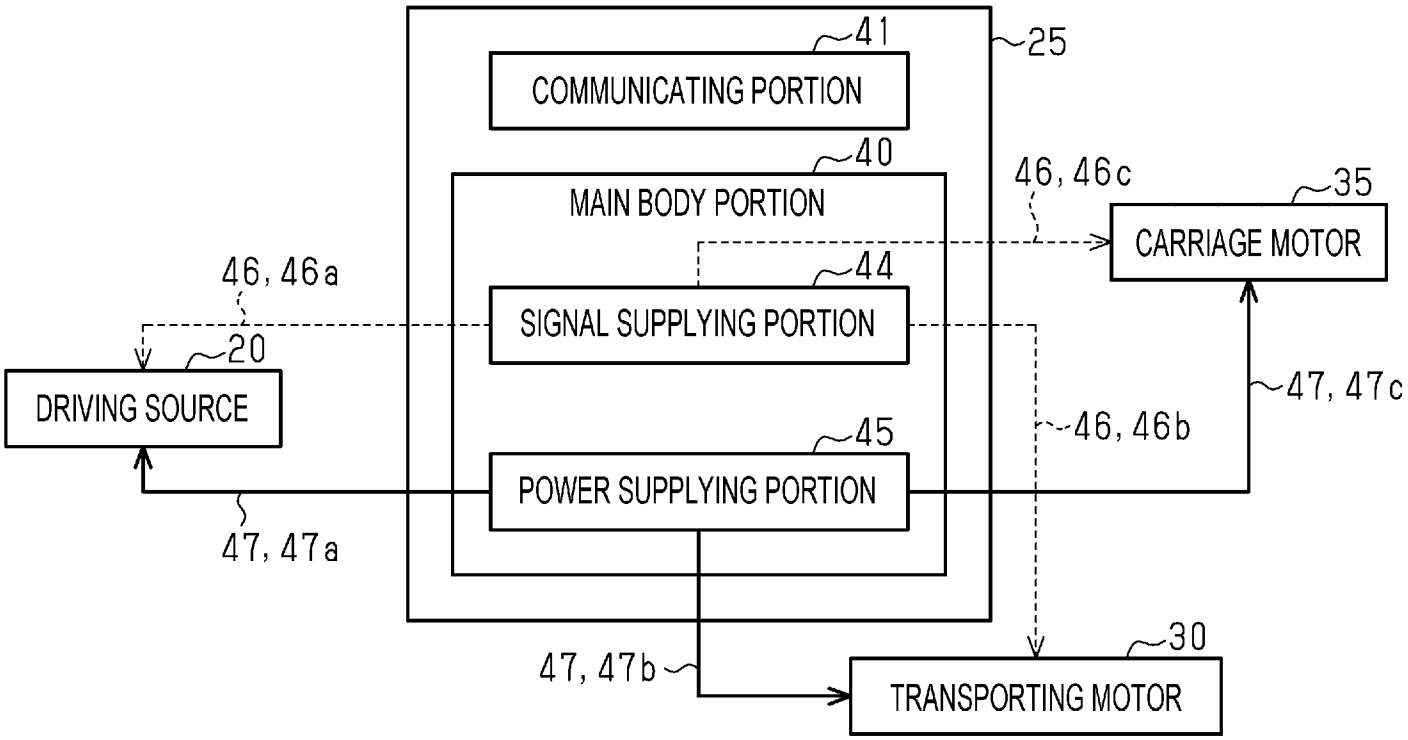
FIG. 4 is a block diagram of a substrate.

As illustrated in FIG. 4, the substrate 25 includes a signal supplying portion 44 for supplying a signal to the driving source 20, the transporting motor 30, and the carriage motor 35, and a power supplying portion 45 for supplying power to the driving source 20, the transporting motor 30, and the carriage motor 35. Also, the signal supplying portion 44 and the power supplying portion 45 are provided in the main body portion 40 and are covered with the shielding portion 26. Also, signal wirings 46 (46*a* to 46*c*) which are illustrated by a dotted line arrow in FIG. 4 are connected to the signal supplying portion 44, and power wirings 47 (47*a* to 47*c*) which are illustrated by a solid line arrow in FIG. 4 are connected to the power supplying portion 45.

Specifically, the printing apparatus 11 is provided with a first signal wiring 46*a* which connects the signal supplying portion 44 and the driving source 20 to each other, the second signal wiring 46*b* which connects the signal supplying portion 44 and the transporting motor 30 to each other, and the third signal wiring 46*c* which connects the signal supplying portion 44 and the carriage motor 35 to each other. Also, the signal supplying portion 44 supplies a signal indicating information such as a driving speed or a driving direction to the driving source 20, the carriage motor 35, and the transporting motor 30 through the signal wiring 46.

In addition, the printing apparatus 11 is provided with the first power wiring 47*a* which connects the power supplying portion 45 and the driving source 20 to each other, the second power wiring 47*b* which connects the power supplying portion 45 and the transporting motor 30 to each other, and the third power wiring 47*c* which connects the power supplying portion 45 and the carriage motor 35 to each other. Also, the power supplying portion 45 supplies power necessary for driving to the driving source 20, the carriage motor 35, and the transporting motor 30 through the power wiring 47.

Figure 5:
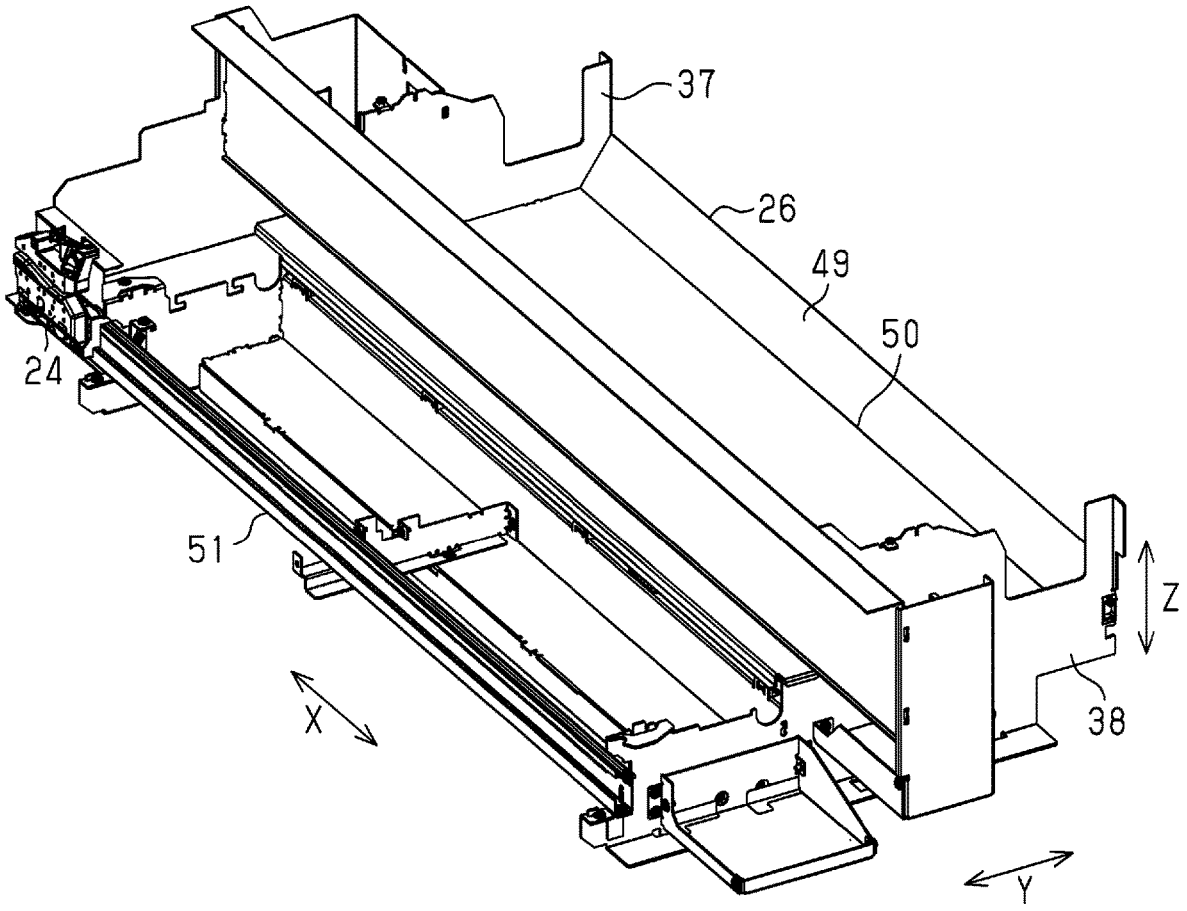
FIG. 5 is a schematic view of a side plate and a shielding portion.

As illustrated in FIG. 5, the shielding portion 26 includes a curved portion 49 in which a part (rear end portion) along the width direction X is inclined and curved in the up direction intersecting the width direction X. The curved portion 49 is provided over the width direction X. Specifically, the curved portion 49 is formed so that a curved line 50 which is a base end of the curved portion 49 extends along the width direction X and extends from the first side plate 37 to the second side plate 38. Further, a cutter frame 51 which movably supports the cutting portion 24 along the width direction X is connected to the pair of side plates 37 and 38.

Figure 6:
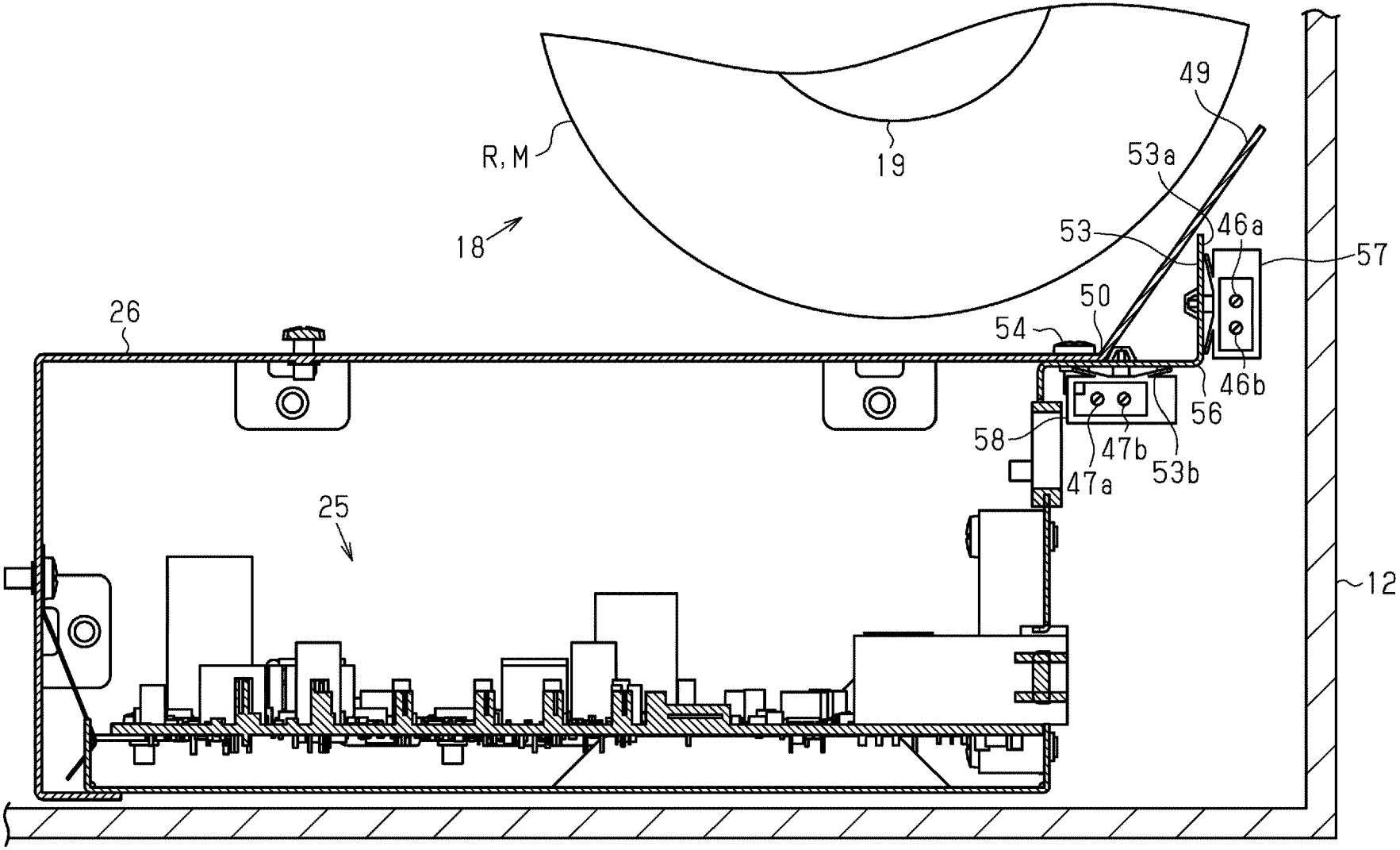
FIG. 6 is a side sectional perspective view of the shielding portion.

As illustrated in FIG. 6, the curved portion 49 is curved to the setting portion 18 side so that a distal end (rear end)

is close to the feeding portion 19. On a lower side of the curved portion 49, the first signal wiring 46*a* and the second signal wiring 46*b* are communicated with each other, and the first power wiring 47*a* and the second power wiring 47*b* are communicated with each other. Therefore, the curved portion 49 partitions wirings (first signal wiring 46*a* and first power wiring 47*a*) connecting the substrate 25 and the driving source 20 and the setting portion 18 in which the medium M is set.

The printing apparatus 11 is provided with a fixing member 53 of a plate shape for fixing the substrate 25 with respect to the shielding portion 26. The fixing member 53 is formed of a metal. Further, the fixing member 53 is fixed to a lower surface of the shielding portion 26 by the spring 54.

The fixing member 53 includes a bending portion 56 which is curved to the curved portion 49 side, and surfaces toward different directions from each other based on the bending portion 56 as a boundary are respectively set to a first surface 53*a* and a second surface 53*b*. Also, the first surface 53*a* and the second surface 53*b* of the embodiment are a surface not facing the shielding portion 26 toward a direction opposite to the shielding portion 26. Specifically, the first surface 53*a* is a surface which is toward a rear side, and the second surface 53*b* is a surface which is toward a lower side.

Further, the printing apparatus 11 is provided with a signal line attachment portion 57 for attaching the first signal wiring 46*a* and the second signal wiring 46*b* to the fixing member 53, and a power line attachment portion 58 for attaching the first power wiring 47*a* and the second power wiring 47*b* to the fixing member 53. Also, the signal line attachment portion 57 is attached on the first surface 53*a*, and the power line attachment portion 58 is attached on the second surface 53*b*.

Therefore, the first signal wiring 46*a* and the second signal wiring 46*b* are attached to the first surface 53*a* of the fixing member 53. In addition, the first power wiring 47*a* and the second power wiring 47*b* are attached to the second surface 53*b* different from the first surface 53*a*.

Next, action of the printing apparatus 11 will be described.

When the signal supplying portion 44 transmits a signal for driving the driving source 20, and the power supplying portion 45 supplies power to the driving source 20, the driving source 20 feeds the medium M by driving the feeding portion 19. At this time, noise is generated due to the first power wiring 47*a* or the driving source 20, but influence of the noise on the substrate 25 or the first signal wiring 46*a* is reduced due to by the shielding portion 26 or the fixing member 53.

According to the embodiment described above, effects as follows can be obtained.

(1) The pair of side plates 37 and 38 is connected to each other by the shielding portion 26 covering the substrate 25. Therefore, the shielding portion 26 serves as a member connecting the pair of side plates 37 and 38 and also serves as a member covering the substrate 25. Therefore, influence of noise and increase of the number of components are suppressed, and the substrate 25 can be attached.

(2) Since the shielding portion 26 includes the curved portion 49, stiffness of the shielding portion 26 can be increased.

(3) The curved portion 49 is curved to the setting portion 18 side. Also, the first signal wiring 46*a* is disposed in a space formed by the curved portion 49. Therefore, the space is effectively used, and thus the first signal wiring 46*a* and the first power wiring 47*a* can be disposed to be hidden by the shielding portion 26.

(4) When the first signal wiring 46*a* and the first power wiring 47*a* are attached to the fixing member 53 fixing the substrate 25, the fixing member 53 serves as a member supporting the first signal wiring 46*a* and the first power wiring 47*a*, and also serves as a member fixing the substrate 25. Therefore, increase of the number of components can be suppressed.

(5) The fixing member 53 is formed of a metal. Further, the first signal wiring 46*a* and the first power wiring 47*a* are attached to a different surface in the fixing member 53. Therefore, influence of noise of the first signal wiring 46*a* and the first power wiring 47*a* which are influenced by each other can be reduced.

(6) Since the communicating portion 41 is disposed on the outer region not covered with the shielding portion 26, a concern that a communication radio wave is blocked by the shielding portion 26 can be reduced.

Also, the embodiment described above may be changed like a modification example described later. In addition, the embodiment described above and the modification example described later may be arbitrarily combined.

The third signal wiring 46*c* or the third power wiring 47*c* may be attached to the fixing member 53. In addition, the signal wiring 46 or the power wiring 47 may not be attached to the fixing member 53.

The communicating portion 41, the signal supplying portion 44, and the power supplying portion 45 are provided as an individual substrate, and may be connected to each other through wirings or connectors.

The curved line 50 may be formed to extend from the first side plate 37 to the second side plate 38 along in a direction intersecting the width direction X.

The fixing member 53 may be formed of a material different from a metal. For example, the member may be formed of a resin.

The fixing member 53 may not include the bending portion 56. For example, the signal wiring 46 and the power wiring 47 may be disposed on the same surface in the fixing member 53. In addition, in the fixing member 53, the signal wiring 46 or the power wiring 47 may be attached to a surface of the shielding portion 26 side. For example, a surface of the fixing member 53 side may be set as the first surface 53*a*, and a surface on an opposite side of the shielding portion 26 may be set as the second surface 53*b*. Also, the signal wiring 46 or the power wiring 47 may be disposed between the shielding portion 26 and the fixing member 53.

A configuration not including the fixing member 53 may be used. For example, the substrate 25, the signal wiring 46, and the power wiring 47 may be attached to the shielding portion 26.

The curved portion 49 may be curved to an opposite side of the setting portion 18.

The curved portion 49 may not partition the signal wiring 46 and the power wiring 47 and the setting portion 18. That is, for example, the signal wiring 46 or the power wiring 47 may be provided upper than the shielding portion 26.

The shielding portion 26 may include a plurality of the curved portions 49. For example, the shielding portion 26 may be formed in a wave shape.

The shielding portion 26 may not include the curved portion 49.

The feeding portion 19 may be used as, for example, a pickup roller which feeds the medium at one a time from the setting portion in which the medium in a state of being cut and separated such as cutform paper is set in a stacked shape. In addition, the feeding portion 19 may be used as a feeding roller which feeds the medium inserted from the outside to the transporting portion 21.

As the ink, an arbitrary ink can be selected if printing can be performed on the medium M by attaching the ink to the medium M. For example, the ink includes ink in which particles of a functional material formed of solid materials such as pigments or metal particles are dissolved, dispersed, or mixed, and also includes various compositions such as aqueous ink, oil ink, gel ink, hot melt ink, and the like.

As the medium M, paper, resins, metals, clothes, ceramics, rubbers, natural materials (woods, stones, and the like), or a composition of these materials may be used. In addition, in consideration of a thickness of the medium, plates, sheets, films, foils, and the like may be used. Further, the shape of the medium may be an arbitrary shape such as a rectangle or a circle. That is, for example, a composite film of paper and resin (resin impregnated paper, resin coated paper, or the like), a composite film of resin and metal (laminated film), a woven fabric, nonwoven fabric, a disc, a circuit substrate, and the like may be used.

The printing apparatus 11 is an apparatus which prints images such as letters, pictures, photographs, and the like by attaching liquid such as ink or fluid such as a toner to the medium, and may be a serial printer, a lateral type printer, a line printer, a page printer, and the like. In addition, an offset printing apparatus, a textile printing apparatus, and the like may be used. In addition, as the printing apparatus, a printing apparatus may be used as long as at least printing function for performing printing on a medium is included, or a complex machine provided with functions other than the printing function may be used. Further, the printing apparatus may be an apparatus which performs printing on a medium having a three-dimensional curved surface.

This application claims priority under 35 U.S.C. § 119 to Japanese Patent Application No. 2017-005899, filed Jan. 17, 2017. The entire disclosure of Japanese Patent Application No. 2017-005899 is hereby incorporated herein by reference.

What is claimed is:

1. A printing apparatus comprising:

a driving source that drives a feeding portion for feeding a medium;

a printing portion that performs printing on the medium;

a substrate that includes a signal supplying portion for supplying a signal to the driving source, and a power supplying portion for supplying power to the driving source;

a pair of side plates that are arranged on one side and the other side with respect to the printing portion therebetween in a width direction; and a shielding plate arranged between the pair of side plates and connecting the pair of side plates, wherein the substrate is covered by the shielding plate by being arranged in a region between the pair of side plates and under the shielding plate, wherein the side plates extend in an up-down direction from near a first surface of a housing of the printing apparatus to near a second surface of the housing of the printing apparatus, wherein the shielding plate, the pair of side plates, and the first surface of the housing of the printing apparatus surround the printing portion, the shielding plate being arranged between the printing portion and the substrate such that the shielding plate separates the printing portion and the substrate.

2. The printing apparatus according to claim 1, wherein the shielding portion includes a curved portion which is curved in a direction intersecting the width direction.

3. The printing apparatus according to claim 2, wherein the curved portion partitions a wiring which connects the substrate and the driving source to each other and a setting portion in which the medium is set, and is curved to the setting portion side.

4. The printing apparatus according to claim 1, further comprising:

a fixing member that fixes the substrate to the shielding portion, wherein the wiring which connects the substrate and the driving source to each other is attached to the fixing member.

5. The printing apparatus according to claim 4, wherein the fixing member is formed of a metal, wherein a signal wiring which connects the signal supplying portion and the driving source to each other is attached to a first surface of the fixing member, and wherein a power wiring which connects the power supplying portion and the driving source to each other is attached to a second surface different from the first surface.

* * * * *